US009631332B2

(12) United States Patent
Shubs, Jr. et al.

(10) Patent No.: US 9,631,332 B2
(45) Date of Patent: Apr. 25, 2017

(54) MOVABLE SAND PLOW FOR LOCOMOTIVE

(71) Applicant: Electro-Motive Diesel, Inc., LaGrange, IL (US)

(72) Inventors: Alexander Shubs, Jr., Chicago, IL (US); Michael Colarossi, Forest Park, IL (US); Tim Kohler, Frankfort, IL (US); Xiaoying Ma, Chicago, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 134 days.

(21) Appl. No.: 14/471,217

(22) Filed: Aug. 28, 2014

(65) Prior Publication Data

US 2016/0060833 A1 Mar. 3, 2016

(51) Int. Cl.
*E01H 8/04* (2006.01)
*E01H 8/10* (2006.01)

(52) U.S. Cl.
CPC ..... *E01H 8/04* (2013.01); *E01H 8/10* (2013.01)

(58) Field of Classification Search
CPC .... E01H 8/00; E01H 8/02; E01H 8/04; E01H 8/10
USPC ..... 37/198, 203, 214, 216, 217
See application file for complete search history.

(56) References Cited

U.S. PATENT DOCUMENTS 319,314 A * 6/1885 Quinn ..... E01H 8/10 37/207
323,043 A 7/1885 Kuhlman
349,122 A 9/1886 Remers
394,350 A 12/1888 Fraser
664,603 A 12/1900 Bell et al.
676,385 A 6/1901 Haegg et al.
881,600 A 3/1908 Manson et al.
1,007,594 A 10/1911 Moorhouse et al.
1,075,927 A 10/1913 Merchant et al.
1,162,338 A 11/1915 Coates et al.
1,182,047 A 5/1916 Stanley et al.
1,406,527 A * 2/1922 Bradley ..... E01H 8/00 37/208
1,412,265 A 4/1922 Barber et al.
1,432,352 A 10/1922 Moricca
1,439,083 A 12/1922 Franz
1,513,497 A 10/1924 Flues
1,518,685 A 12/1924 Berczik
1,527,541 A 2/1925 Dougherty et al.
1,548,694 A 8/1925 Webb et al.
1,601,533 A 9/1926 Klima et al.
1,777,588 A * 10/1930 Tellis ..... E01B 27/025 37/105
1,833,859 A 11/1931 Robinson et al.
1,854,676 A 4/1932 Seaboch et al.
(Continued)

*Primary Examiner* — Jamie L McGowan
(74) *Attorney, Agent, or Firm* — Miller, Matthias & Hull

(57) ABSTRACT

A moveable plow for a locomotive suitable for operating in sandy environments is provided. The moveable plow comprises a body and a wearable lip. The body forms a curl at its top edge along substantially the entire body width to channel the flow of sand outwardly. The lip is removably affixed to the body and contacts a rail. The moveable plow is attached to a bogie by a pneumatically operated height adjusting mechanism that can raise or lower the moveable plow. The moveable plow and rail define a sweep angle equal to or greater than an angle of repose of the sand in the surrounding environment.

10 Claims, 6 Drawing Sheets

(56) References Cited

U.S. PATENT DOCUMENTS

| | | | | | |
|---|---|---|---|---|---|
| 2,105,416 | A | | 1/1938 | Hansen et al. | |
| 2,184,046 | A | * | 12/1939 | Karinshak, Jr. | E01H 8/00 37/105 |
| 2,374,312 | A | * | 4/1945 | Tackett | E01H 8/00 172/26 |
| 2,840,930 | A | * | 7/1958 | Mundell | E01H 8/00 37/104 |
| 3,019,536 | A | * | 2/1962 | Kershaw | E01B 27/025 104/2 |
| 3,305,952 | A | * | 2/1967 | Dressler | E01H 8/00 104/279 |
| 3,468,042 | A | * | 9/1969 | Coy | E01B 27/025 15/54 |
| 3,491,467 | A | * | 1/1970 | Finger | E01B 27/025 104/279 |
| 3,651,587 | A | * | 3/1972 | Plasser | E01B 27/025 172/735 |
| 4,235,029 | A | * | 11/1980 | Ulm | E01B 27/025 104/279 |
| 4,274,212 | A | * | 6/1981 | Kurkela | E01H 8/04 37/105 |
| 4,282,663 | A | * | 8/1981 | Theurer | E01B 27/025 104/6 |
| 5,657,700 | A | * | 8/1997 | Bounds | B61D 7/30 104/2 |
| 5,724,755 | A | * | 3/1998 | Weagley | E01H 5/06 37/231 |
| 6,688,021 | B2 | | 2/2004 | Baig et al. | |
| 7,555,853 | B2 | * | 7/2009 | Paonessa | E01H 5/062 172/261 |
| 7,578,078 | B2 | | 8/2009 | Gandolfi et al. | |
| 2002/0170207 | A1 | | 11/2002 | Ahmed Baig et al. | |
| 2012/0123617 | A1 | | 5/2012 | Noffsinger et al. | |

* cited by examiner

MOVABLE SAND PLOW FOR LOCOMOTIVE

BACKGROUND

Field of the Disclosure

This disclosure relates to a locomotive plow. More particularly, this disclosure relates to a moveable sand plow for a locomotive suitable for operating in sandy environments.

Description of the Related Art

Railroads that operate in desert environments have observed that drifting sand can quickly cause a buildup of sand on the rails. If not removed, this buildup can lead to excessive wheel wear. Sand buildup can even lead to derailments. The present disclosure addresses these problems.

BRIEF SUMMARY OF THE DISCLOSURE

The present disclosure relates to a moveable plow for a locomotive sand plow system. In one embodiment the moveable plow comprises a body and a detachable lip.

The body has a width and defines a plane substantially orthogonal to a plane defined by a rail. The body extends from an inner vertical edge inward of the rail to an outer vertical edge outward of the rail and from a lower edge to a top edge. The body forms a curl at its top edge along substantially the entire body width to channel the flow of sand outwardly. The curl is most pronounced at the outer vertical edge.

The lip is removably affixed to and extends downwardly from the body. The lip has a substantially linear first edge and a parallel, opposing substantially linear second edge. The lip is invertible between a first position in which the first edge is facing down and a second position in which the second edge is facing down.

In one aspect of the disclosure the moveable plow is positioned over the rail so that the moveable plow straddles the rail and contacts the rail.

In a further aspect of the disclosure the moveable plow is attached to a bogie by a pneumatically operated height adjusting mechanism that can raise or lower the moveable plow.

In another aspect of the disclosure the moveable plow and rail define a sweep angle equal to or greater than an angle of repose of the sand in the surrounding environment.

In still another aspect of the disclosure a method of positioning a plurality of forward facing moveable plows is provided, where each of the moveable plows is mounted to one of a series of connected locomotives. The method may comprise the steps of activating a plow system using a single switch; the plow system determining which direction the locomotives are moving and the plow system automatically adjusting the height of each of the moveable plows until each moveable plow contacts a set of rails.

DETAILED DESCRIPTION OF THE DISCLOSURE

Figure 1:
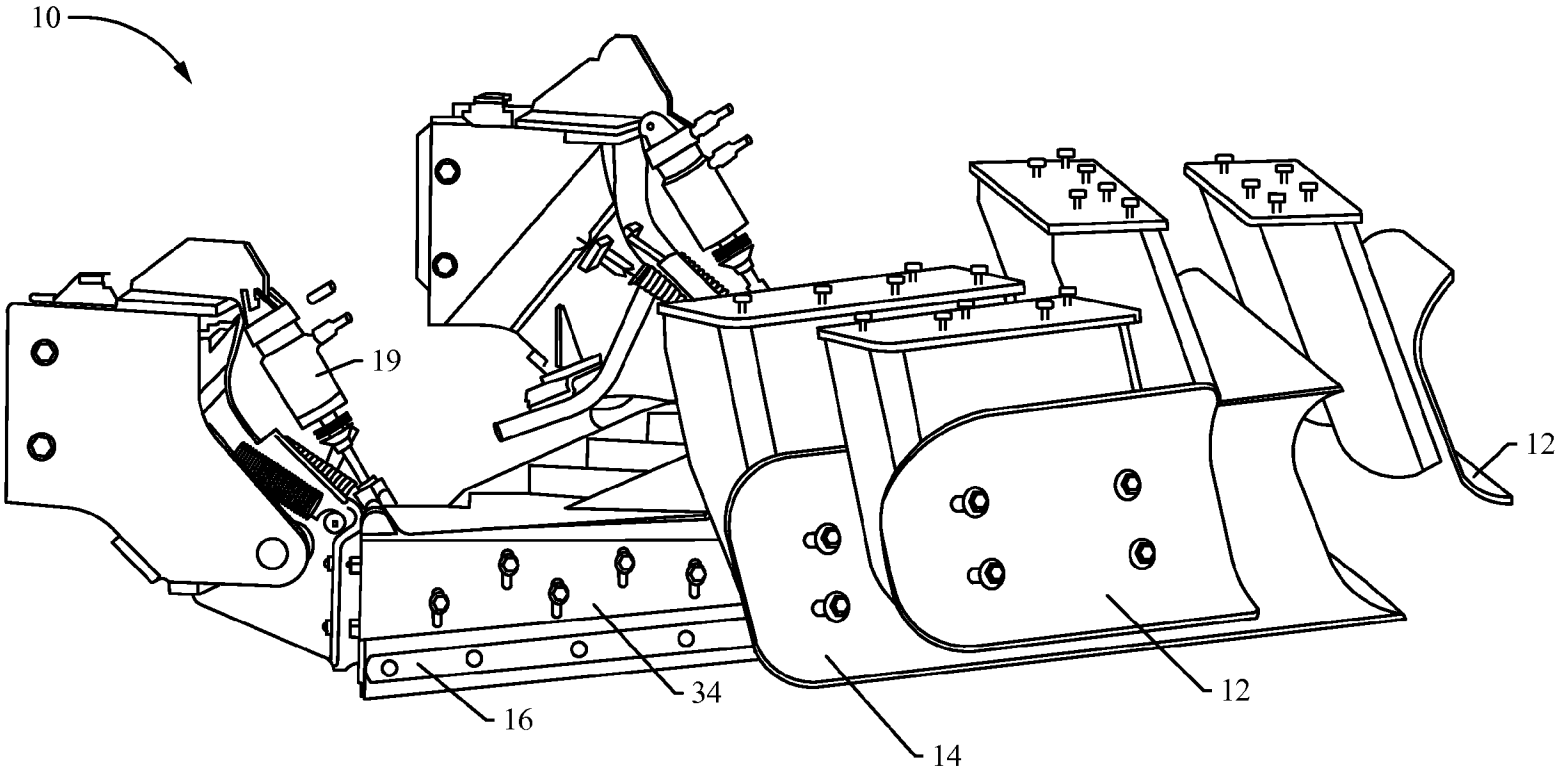
FIG. 1 is a perspective view of a sand plow system according to the disclosure.

While this disclosure may be embodied in many forms, there is shown in the drawings and will herein be described in detail one or more embodiments with the understanding that this disclosure is to be considered an exemplification of the principles of the disclosure and is not intended to limit the disclosure to the illustrated embodiments.

Turning to the drawings, there is shown in FIG. 1 a plow system 10 for a locomotive 100. The plow system 10 may comprise three sets of plows, including a set of fixed front plows 12, a set of fixed rear plows 14 and a set of moveable plows 16.

The set of fixed front plows 12 may comprise two fixed front plows 12 arranged at an angle to each other and positioned in front in the direction or travel. The fixed front plows 12 may be set highest from the tracks of the three sets of plows and can move large amounts of sand piled high on the tracks if necessary. The fixed front plows 12 may be fixed to the underframe of the locomotive 100

The set of fixed rear plows 14 may comprise two rear fixed rear plows 14 arranged at an angle and joined together to form a single, unitary V-shape structure positioned behind the fixed front plows 12. The fixed rear plows 14 are designed to move most of the remaining sand out of the way.

Figure 2:
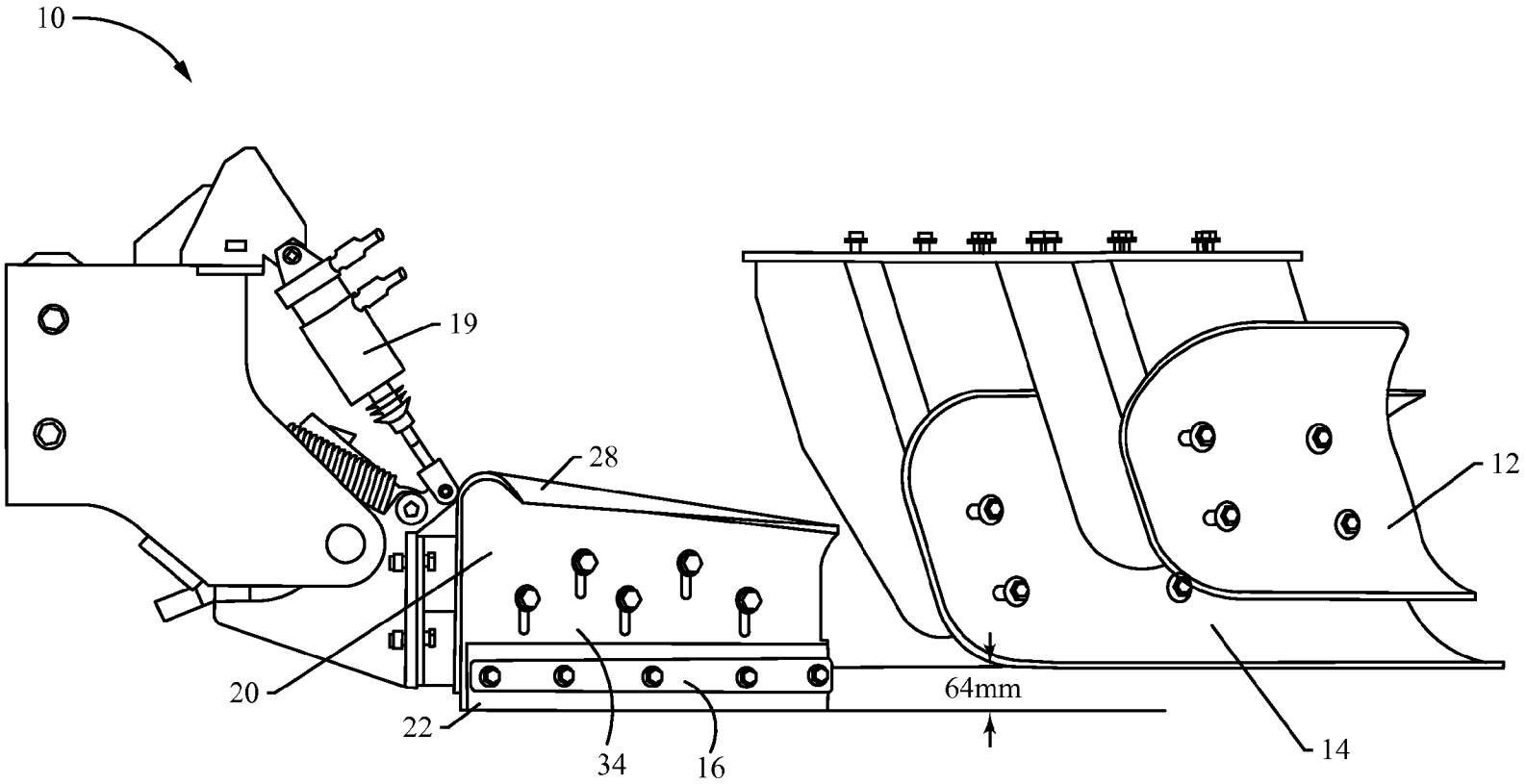
FIG. 2 is a side view of the sand plow system of FIG. 1.

FIG. 2 is a side view of the sand plow system of FIG. 1. Preferably the fixed rear plows 14 are set as low as possible without touching the rails (and taking into account factors such as suspension travel) to minimize the plow load of the moveable plows 16. More preferably, the fixed rear plows 14 are set between 64 mm and 150 mm above the tracks. The two moveable plows 16 may be located behind the fixed rear plows 14 and arranged at an angle to each other.

Figure 3:
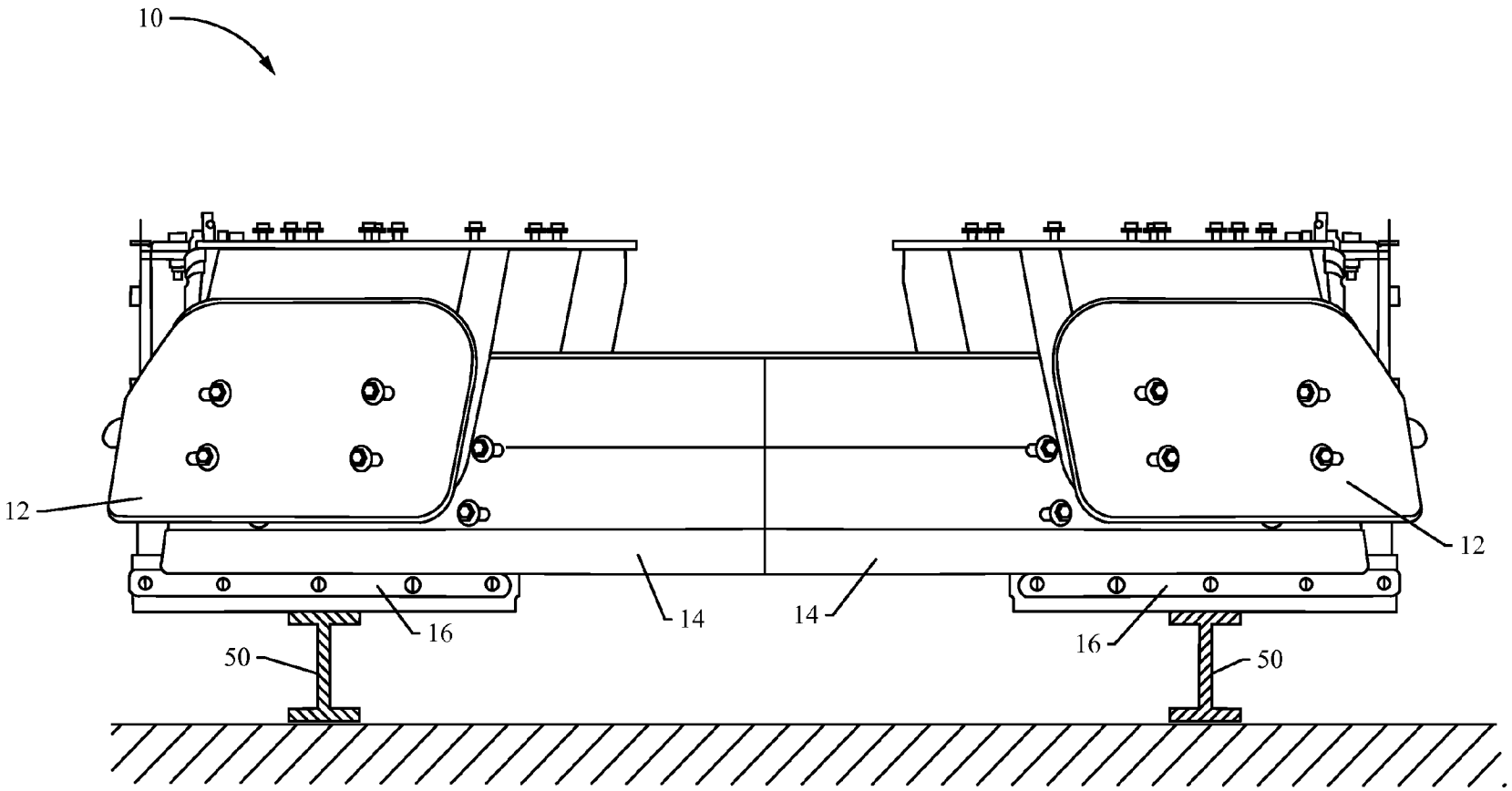
FIG. 3 is a front view of the sand plow system of FIG. 1.

FIG. 3 is a front view of the sand plow system 10 of FIG. 1. The moveable plows 16 are positioned over the rails 50 so that each moveable plow 16 straddles a rail 50. The moveable plows 16 touch the rails 50 so they can sweep any remaining sand from the rails 50 left by the fixed plows 12, 14.

The moveable plows 16 may be height adjustable to take into account variation in wheel diameter due to wheel wear and other factors that affect the vertical position of the moveable plows 16. Wheel wear is a function of, among other things, the rails, the operating environment, the wheel hardness and the wheel profile. As the locomotive wheels 104 wear, the plow system 10 in general and the moveable plows 16 in particular may have to be adjusted upwards.

Figure 4:
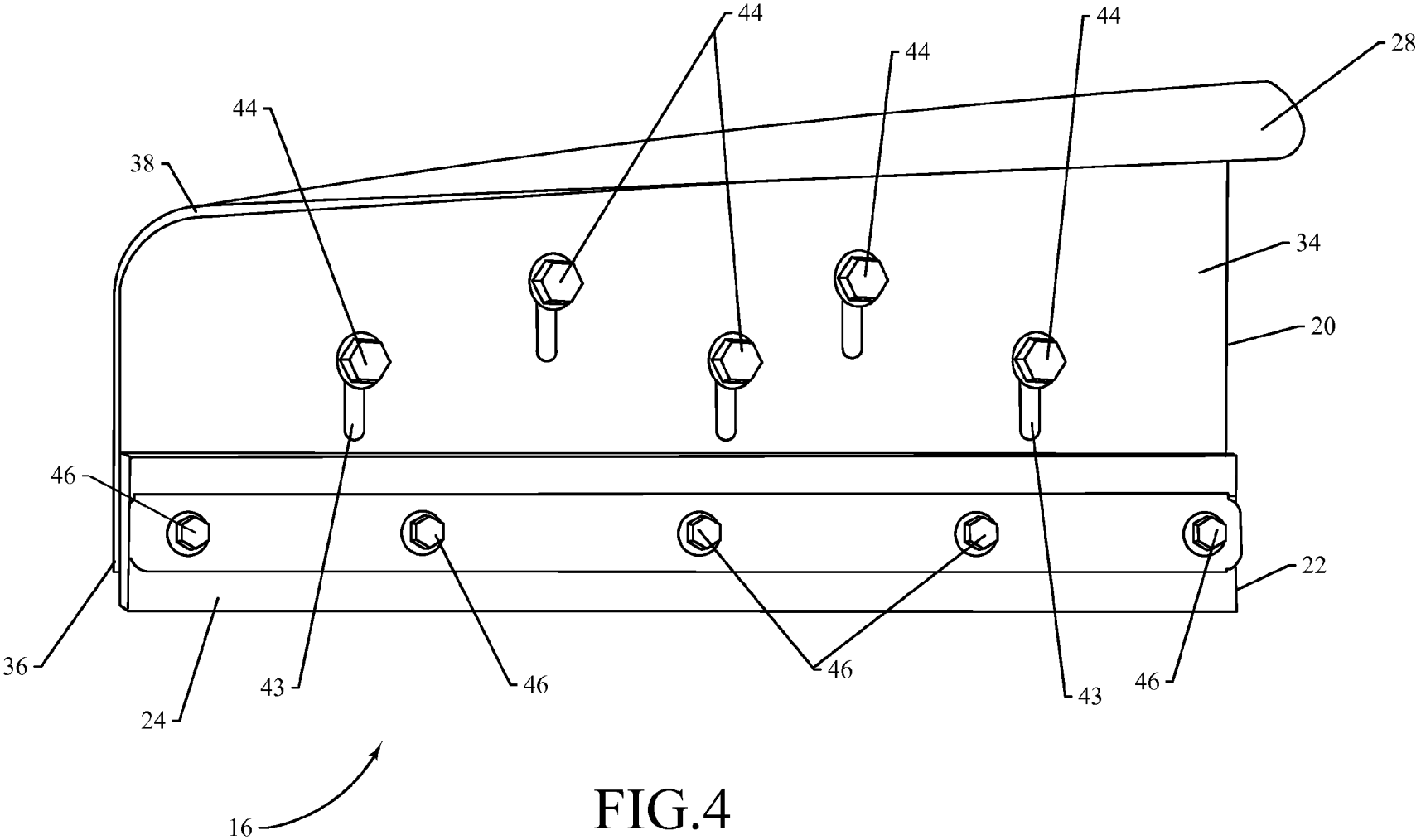
FIG. 4 is a front view of a right side mounted moveable sand plow according to the disclosure.

FIG. 4 is a front view of a right side mounted moveable plow 16 according to the disclosure. The moveable plow 16 comprises a body 20 and a lip 22 affixed to and extending downwardly (in the direction of the rail 50) from the body 20.

The body 20 may be made from metal or any material capable of withstanding the high stress loads caused by impacting sand. The body 20 has a width and extends from an inner vertical edge 30 inward of the rail 50 (FIG. 5) to an outer vertical edge 32 outward of the rail 50 and from a lower, substantially linear, downward facing, edge 36 to a top edge 38. Preferably the body 20 is oriented substantially vertically with respect to the ground. That is, the body 20 defines a plane substantially orthogonal to a plane defined by the rails 50.

Preferably each moveable plow body 20 forms a curl 28 extending substantially the entire body width at its top edge 38 to channel the flow of sand 40 outwardly. If the sand 40 starts to override the moveable plow 16, the curl 28 will guide the sand 40 outward and off to the side, away from the locomotive wheels. Preferably the curl 28 is most pronounced at the outer vertical edge 32 of the body 20 and diminishes at the inner vertical edge 30. In other words, preferably the body top edge 38 extends farthest in front of the plane of the body 20 at the outer vertical edge 32 and least in front of the plane of the body 20 at the inner vertical edge 30.

Preferably each moveable plow 16 has a relatively unobstructed plow front face 34 that efficiently moves sand laterally across the front face 34 of the moveable plow 16. For example, in one aspect only bolts 44 extend forward to the body 20.

The lip 22 may have a substantially linear lower edge 24 preferably in contact with the rail 50. The lip 22 may be made from polyurethane or any other suitable material. The lip 22 may be bolted on or otherwise affixed to the body 20 and may be replaced after excessive wear. The lip 22 is invertible, that is, it can be flipped over so that the top edge 26 is positioned facing down against the rail 50, effectively doubling the useful life of the lip 22.

Figure 5:
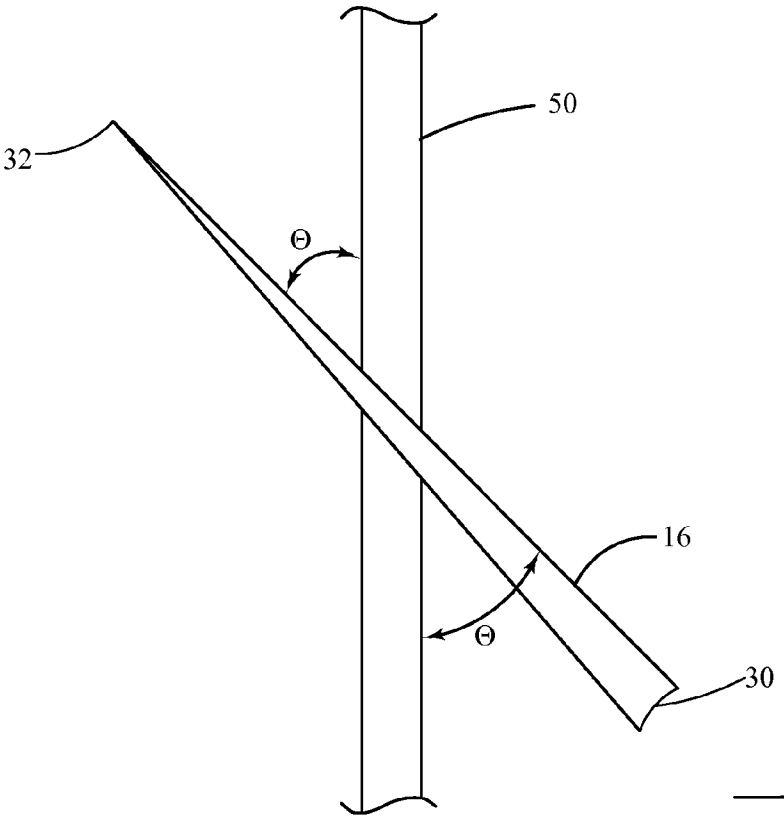
FIG. 5 is a top view of a moveable plow and rail showing the sweep angle.

FIG. 5 is a top view of a moveable plow 16 and rail 50 as the moveable plow 16 might be oriented with respect to a rail 50. The moveable plow 16 and rail 50 form a sweep angle (Ø) defined as the acute angle formed by the moveable plow 16 and its respective rail 50 as shown in the figure.

Figure 6:
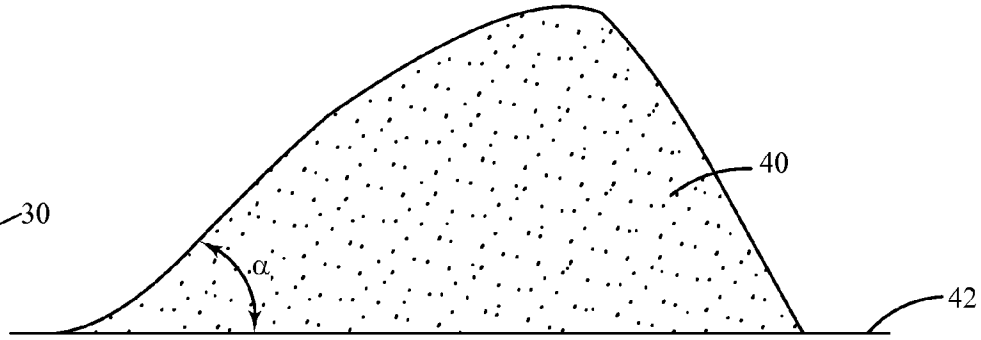
FIG. 6 is a side view of a pile of sand showing the angle of repose.

FIG. 6 is a side view of a pile of sand 40 showing the angle of repose. The angle of repose is the angle ($\alpha$) formed by the sand 40 as it naturally accumulates and the ground 42.

Preferably the sweep angle (Ø) for each moveable plow 16 is equal to or greater than the angle of repose ($\alpha$) of the sand 40. This configuration is intended to prevent the build-up of sand 40 in front of the locomotive 100. An operable sweep angle (Ø) is in the range of about 30 degrees to about 45 degrees, with a preferred sweep angle of about 37.5 degrees. Of course, the preferred sweep angle is a function of, among other things, the environmental conditions.

The moveable plow 16 needs to be kept in direct contact with the rail 50 as the lip 22 wears down and/or the wheels 104 wear down. Thus the contact portion of the moveable plow 16, that is, the lower edge of the lip 22, can be adjusted vertically in one of three ways:

First, the lip 22 may be manually height adjustable with respect to the body 20 at the points of attachment to the body 20. This may be accomplished by attaching the lip 22 to the body 20 with fasteners such as bolts 46 that extend through vertical slots (obscured in FIG. 4) in the body 20. To manually adjust the height of the lip 22 the lip bolts 46 are loosened, repositioned along the vertical slots and then re-tightened.

Second, the entire moveable plow 16 may be manually height adjustable with respect to height adjusting mechanism 19 at the points of attachment to the height adjusting mechanism 19. This may be accomplished by attaching the moveable plow 16 to the height adjusting mechanism 19 with bolts 44 that extend through vertical slots 43 in the body 20. To manually adjust the height of the moveable plow 16 the bolts 44 are loosened, repositioned along the vertical slots 43 and then re-tightened. Material behind the slots 43 keeps sand from flowing through the slots 43.

Third, each moveable plow 16 may be automatically height adjustable with respect to the locomotive 100 by attaching the moveable plow 16 to a bogie 18 (FIG. 7) with a pneumatically actuated height adjusting mechanism 19. The height adjusting mechanism 19 may be attached to the rear surface of the moveable plow 16 so as to not obstruct the movement of sand 40 across the planar front face 34 of the moveable plow 16. The height adjusting mechanism 19 may be activated by an operator as described below.

Figure 7:
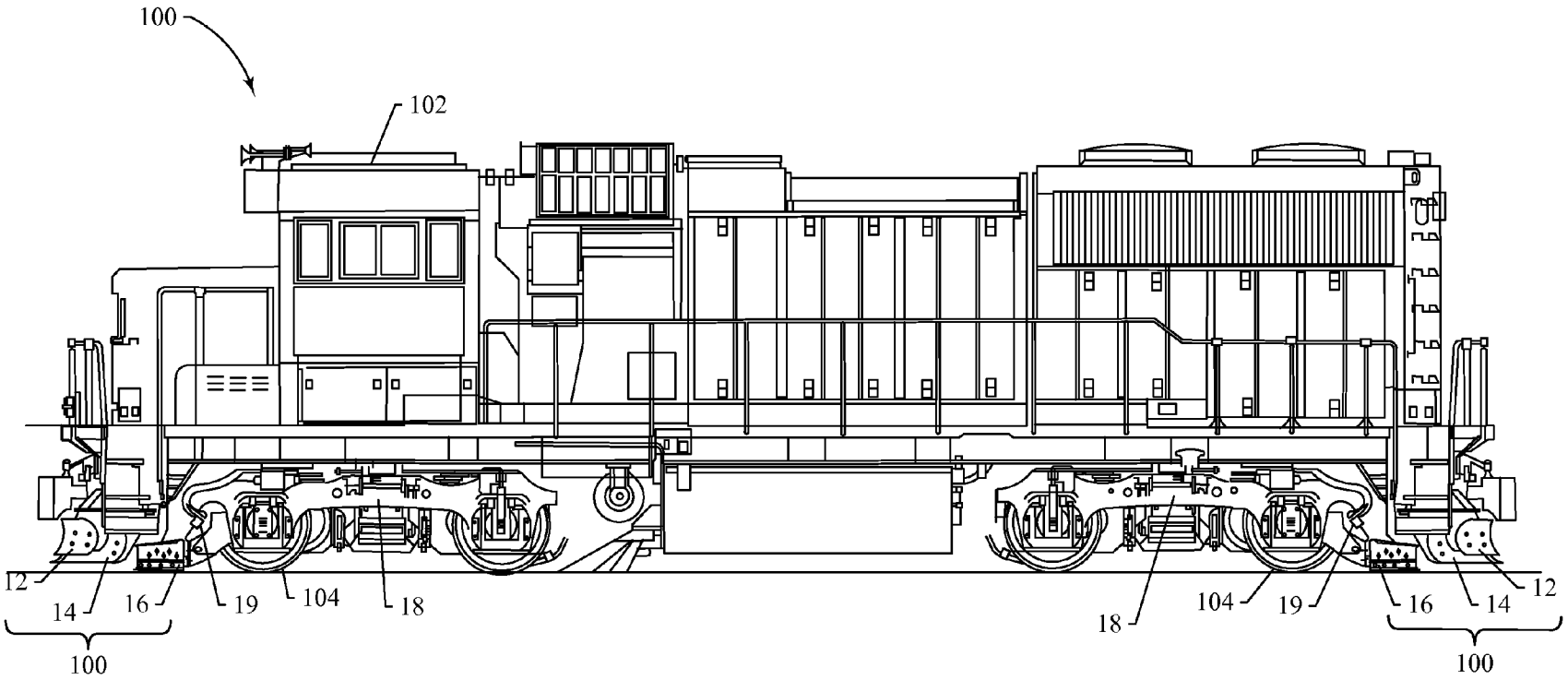
FIG. 7 is a side view of a locomotive carrying a plow system according to the disclosure.

FIG. 7 is a side view of a locomotive 100 carrying a plow system 10 according to the disclosure. The locomotive comprises cab 102 and wheels 104. The locomotive 100 may carry a second plow system 100 in the rear of the locomotive 100. As noted above, the moveable plows 16 may be attached to bogies 18 and may be pneumatically activated.

The system 10 may be set up to operate by the activation of a single switch. When activated, the system 10 determines which direction the locomotive 100 is moving and automatically adjusts the height of the moveable plows 16, typically by activating the height adjusting mechanism 19, to keep the moveable plow 16 directly on the rail 50. If multiple locomotives 100 are hooked up together and the operator activates the system 10, the system 10 can adjust the appropriate moveable plows 16, that is, the moveable plows 16 on the front of the leading locomotive 100 and the moveable plows 16 on rear of the trailing locomotive 100. In this way the train can be operated in either direction in sandy conditions.

It is understood that the embodiments of the disclosure described above includes only particular examples which serve to illustrate the principles of the disclosure. Modifications and alternative embodiments of the disclosure are contemplated which do not depart from the scope of the disclosure as defined by the foregoing teachings and appended claims. It is intended that the claims cover all such modifications and alternative embodiments that fall within their scope.

We claim:

1. A moveable sand plow for removing sand from a pair of railroad rails, the moveable sand plow comprising:

a pair of plow bodies including a first body and a second body, each of the first body and the second body having a width and defining a body plane that is substantially orthogonal to a plane defined by the pair of railroad rails, a vertical direction of the moveable sand plow being orthogonal to the plane defined by the pair of railroad rails, a forward direction of the moveable sand plow being orthogonal to vertical direction, and a transverse direction of the moveable sand plow extending between the pair of railroad rails and being orthogonal to the vertical direction and the forward direction, each of the first body and the second body extending from an inner vertical edge disposed between the pair of railroad rails to an outer vertical edge disposed outside of the pair of railroad rails, and extending from a lower edge to a top edge along the vertical direction, the inner vertical edge of the first body being spaced apart from the inner vertical edge of the second body along the transverse direction, the inner vertical edge of each of the first body and the second body being disposed forward of the outer vertical edge of the first body and the second body along the forward direction, each of the first body and the second body including a curl that defines the top edge, the curl extending along substantially an entire body width to channel a flow of sand outward of the pair of railroad rails, the curl being most pronounced at the outer vertical edge, and a lip removably affixed to and extending downwardly from the lower edge, the lip having a substantially linear first edge and a parallel, opposing substantially linear second edge, each of the first body and the second body defining a plurality of vertical slots therethrough, each vertical slot of the plurality of vertical slots at least partly facing the forward direction; and a pneumatically operated height adjusting mechanism coupled to each of the first body and the second body via fasteners through the plurality of vertical slots, the pneumatically operated height adjusting mechanism being configured to couple the pair of plow bodies to a bogie of a locomotive, and being configured to raise or lower the moveable plow along the vertical direction, wherein the lip of each of the first body and the second body is moveable between a first position in which the first edge is facing down along the vertical direction and a second position in which the second edge is facing down along the vertical direction.

2. The moveable sand plow of claim 1, wherein the body is made from metal, and the lip is made from polyurethane.

3. The moveable sand plow of claim 1, wherein the moveable sand plow has an unobstructed planar front face except for bolts extending forward of the front face along the forward direction.

4. The moveable sand plow of claim 1, wherein each lip is invertible between a first position in which the first edge is positioned to contact a respective rail of the pair of railroad rails and a second position in which the second edge is positioned to contact the respective rail.

5. The moveable sand plow of claim 1, wherein the moveable sand plow is positioned over the pair of railroad rails so that the first body straddles one rail of the pair of railroad rails, and the second body straddles another rail of the pair of railroad rails.

6. The moveable sand plow of claim 1, wherein the moveable sand plow is mounted to a wheeled locomotive and has a height relative to the wheeled locomotive that can be adjusted to compensate for a variation in locomotive wheel diameter.

7. The moveable sand plow of claim 1, wherein the moveable sand plow and the pair or railroad rails define a sweep angle (Ø) equal to or greater than an angle of repose ($\alpha$) of the sand.

8. The moveable sand plow of claim 1, wherein the moveable sand plow and the pair of railroad rails define a sweep angle (Ø) between about 30 degrees and about 45 degrees.

9. The moveable sand plow of claim 8, wherein the moveable sand plow and the pair of railroad rails define a sweep angle (Ø) of about 37.5 degrees.

10. A method for positioning a height of a moveable sand plow of a plow system with respect to a pair of railroad rails, the moveable sand plow being mounted to one locomotive of a series of connected wheeled locomotives, the moveable sand plow comprising a pair of plow bodies including a first body and a second body, each of the first body and the second body having a width and defining a body plane that is substantially orthogonal to a plane defined by the pair of railroad rails, a vertical direction of the moveable sand plow being orthogonal to the plane defined by the pair of railroad rails, a forward direction of the moveable sand plow being orthogonal to vertical direction, and a transverse direction of the moveable sand plow extending between the pair of railroad rails and being orthogonal to the vertical direction and the forward direction, each of the first body and the second body extending from an inner vertical edge disposed between the pair of railroad rails to an outer vertical edge disposed outside of the pair of railroad rails, and extending from a lower edge to a top edge along the vertical direction, the inner vertical edge of the first body being spaced apart from the inner vertical edge of the second body along the transverse direction, the inner vertical edge of each of the first body and the second body being disposed forward of the outer vertical edge of the first body and the second body along the forward direction, each of the first body and the second body including a curl that defines the top edge, the curl extending along substantially an entire body width to channel a flow of sand outward of the pair of railroad rails, the curl being most pronounced at the outer vertical edge, and a lip removably affixed to and extending downwardly from the lower edge, the lip having a substantially linear first edge and a parallel, opposing substantially linear second edge, each of the first body and the second body defining a plurality of vertical slots therethrough, each vertical slot of the plurality of vertical slots at least partly facing the forward direction; and a pneumatically operated height adjusting mechanism coupled to each of the first body and the second body via fasteners through the plurality of vertical slots, the pneumatically operated height adjusting mechanism being configured to couple the pair of plow bodies to a bogie of a locomotive, and being configured to raise or lower the moveable plow along the vertical direction, wherein the lip of each of the first body and the second body is moveable between a first position in which the first edge is facing down along the vertical direction and a second position in which the second edge is facing down along the vertical direction, the method comprising:

activating the plow system using a single switch;

determining, via the plow system, which direction the locomotive is moving along the pair of railroad rails; and automatically adjusting, via the plow system, the height of the first body and the second body relative to a first rail and a second rail, respectively, of the pair of railroad rails until the first body contacts the first rail and the second body contacts the second rail.

* * * * *